US009919331B2

(12) United States Patent
Scheffer et al.

(10) Patent No.: US 9,919,331 B2
(45) Date of Patent: Mar. 20, 2018

(54) HANDHELD SHOWER SYSTEM

(71) Applicant: Moen Incorporated, North Olmsted, OH (US)

(72) Inventors: Georg Scheffer, Berea, OH (US); William Wray Shepler, North Olmsted, OH (US); Eric John Tonissen, Olmsted Township, OH (US)

(73) Assignee: Moen Incorporated, North Olmsted, OH (US)

( * ) Notice: Subject to any disclaimer, the term of this patent is extended or adjusted under 35 U.S.C. 154(b) by 0 days.

(21) Appl. No.: 15/041,563

(22) Filed: Feb. 11, 2016

(65) Prior Publication Data

US 2016/0236223 A1 Aug. 18, 2016

Related U.S. Application Data

(60) Provisional application No. 62/116,287, filed on Feb. 13, 2015.

(51) Int. Cl.

| | |
|---|---|
| ***B05B 15/00*** | (2006.01) |
| ***B05B 15/06*** | (2006.01) |
| ***E03C 1/06*** | (2006.01) |
| *B05B 1/18* | (2006.01) |

(52) U.S. Cl.

CPC ..... *B05B 15/061* (2013.01); *E03C 1/06* (2013.01); *B05B 1/185* (2013.01)

(58) Field of Classification Search

CPC ..... B05B 1/185; B05B 15/061; E03C 1/06
USPC ..... 239/273
See application file for complete search history.

(56) References Cited

U.S. PATENT DOCUMENTS

| | | | | |
|---|---|---|---|---|
| 3,181,895 | A | 5/1965 | Cator | |
| 6,446,278 | B1 * | 9/2002 | Lin | E03C 1/06 4/615 |
| 6,594,832 | B2 | 7/2003 | Yang | |
| 7,252,112 | B1 | 8/2007 | Imler et al. | |
| 7,753,079 | B2 | 7/2010 | Nelson | |
| 7,793,987 | B1 | 9/2010 | Busch et al. | |
| 7,909,061 | B2 | 3/2011 | Nelson | |
| 8,205,846 | B2 | 6/2012 | Glunk | |
| 8,387,661 | B2 | 3/2013 | Nelson | |
| 8,413,686 | B2 | 4/2013 | Ko | |
| 8,567,430 | B2 | 10/2013 | Allen et al. | |
| 2007/0022528 | A1 * | 2/2007 | Gilbert | B05B 1/18 4/615 |
| 2009/0007330 | A1 | 1/2009 | Genord et al. | |
| 2010/0043135 | A1 | 2/2010 | Patterson et al. | |
| 2010/0170587 | A1 | 7/2010 | Kaess | |
| 2013/0299608 | A1 | 11/2013 | Spangler et al. | |
| 2017/0014849 | A1 * | 1/2017 | Gao | B05B 15/061 |

FOREIGN PATENT DOCUMENTS

| | | |
|---|---|---|
| CN | 202343352 U | 7/2012 |
| CN | 102873000 A | 1/2013 |

* cited by examiner

*Primary Examiner* — Viet Le
(74) *Attorney, Agent, or Firm* — Calfee, Halter & Griswold LLP

(57) ABSTRACT

The present invention provides a handheld shower system with magnetic docking and a mechanical retention feature.

20 Claims, 14 Drawing Sheets

HANDHELD SHOWER SYSTEM

CROSS-REFERENCE TO RELATED APPLICATION

This application claims the benefit of U.S. Provisional Application No. 62/116,287, filed Feb. 13, 2015, the entire disclosure of which is hereby incorporated by reference.

FIELD

The present invention relates generally to a handheld shower system, and, more particularly, to a handheld shower system with magnetic docking and a mechanical retention feature.

BACKGROUND

Handheld showers are known. Further, handheld showers with magnetic docking are known. However, handheld showers with magnetic docking can accidentally undock. Additional mechanisms for securing handheld showers with magnetic docking are desired. Difficulties can be encountered in designing handheld showers with magnetic docking that are securely docked.

SUMMARY

The present invention provides a handheld shower system with magnetic docking and a mechanical retention feature.

In an exemplary embodiment, the handheld shower system includes a handheld and a cradle. The handheld includes a handheld housing. The handheld housing is operable to attach to a spray face. The cradle includes a cradle housing. One of the handheld housing and the cradle housing includes a lip, and the other of the handheld housing and the cradle housing includes a tab. One of the handheld and the cradle includes a magnet, and the other of the handheld and the cradle includes a magnet or a magnetically attractable material. The handheld is docked on the cradle by attraction of the magnet of one of the handheld and the cradle to the magnet or the magnetically attractable material of the other of the handheld and the cradle. As a downward force is applied to the handheld while the handheld is docked on the cradle, the tab on the cradle housing contacts the lip on the handheld housing and the handheld is retained on the cradle. As an upward force is applied to the handheld while the handheld is docked on the cradle, the tab on the cradle housing does not contact the lip on the handheld housing and the handheld becomes undocked from the cradle.

In an exemplary embodiment, the handheld shower system includes a handheld and a cradle. The handheld includes a handheld housing. The handheld housing includes a handle and a head. The handle includes an inlet. The head includes an outlet. The handheld housing includes a passageway extending between the inlet and the outlet. The head has a front side and a back side. The front side of the head is operable to attach to a spray face. The back side of the head includes a lip. The cradle includes a cradle housing. The cradle housing includes an inlet, an outlet, and a passageway extending between the inlet and the outlet. The cradle housing has a front end and a back end. The front end of the cradle housing includes a tab. The outlet of the cradle housing is operable to be fluidly connected to the inlet of the handheld. One of the handheld and the cradle includes a magnet, and the other of the handheld and the cradle includes a magnet or a magnetically attractable material. The handheld is docked on the cradle by attraction of the magnet of one of the handheld and the cradle to the magnet or the magnetically attractable material of the other of the handheld and the cradle. As a downward force is applied to the handheld while the handheld is docked on the cradle, the tab on the front end of the cradle housing contacts the lip on the back side of the head and the handheld is retained on the cradle. As an upward force is applied to the handheld while the handheld is docked on the cradle, the tab on the front end of the cradle housing does not contact the lip on the back side of the head and the handheld becomes undocked from the cradle.

In an exemplary embodiment, the handheld shower system includes a handheld and a cradle. The handheld includes a handheld housing. The handheld housing includes a handheld body and a handheld cover. The handheld body includes a handle and a head. The handle includes an inlet. The head includes an outlet. The handheld body includes a passageway extending between the inlet and the outlet. The head has a front side and a back side. The front side of the head is operable to attach to a spray face. The back side of the head is operable to attach to the handheld cover. The handheld cover includes a lip. The cradle includes a cradle housing. The cradle housing includes a cradle body and a cradle cover. The cradle body includes an inlet, an outlet, and a passageway extending between the inlet and the outlet. The cradle body has a front end and a back end. The front end of the cradle body includes a tab. The outlet of the cradle housing is operable to be fluidly connected to the inlet of the handle. One of the handheld and the cradle includes a magnet, and the other of the handheld and the cradle includes a magnet or a magnetically attractable material. The handheld is docked on the cradle by attraction of the magnet of one of the handheld and the cradle to the magnet or the magnetically attractable material of the other of the handheld and the cradle. As a downward force is applied to the handheld while the handheld is docked on the cradle, the tab on the front end of the cradle body contacts the lip on the handheld cover and the handheld is retained on the cradle. As an upward force is applied to the handheld while the handheld is docked on the cradle, the tab on the front end of the cradle body does not contact the lip on the handheld cover and the handheld becomes undocked from the cradle.

BRIEF DESCRIPTION OF THE DRAWINGS

—FIG. 1*a* is a perspective view, FIG. 1*b* is a side view, FIG. 1*c* is a rear view, FIG. 1*d* is a top view, and FIG. 1*e* is a cross-sectional view taken along line 1*e*-1*e* in FIG. 1*d;*

*-FIG. 2*a* is a perspective view, FIG. 2*b* is an exploded perspective view, FIG. 2*c* is a side view, FIG. 2*d* is a front view, FIG. 2*e* is a rear view, FIG. 2*f* is a top view, and FIG. 2*g* is a cross-sectional view taken along line 2*g*-2*g* in FIG. 2*f;*

*-FIG. 3*a* is a perspective view, FIG. 3*b* is an exploded perspective view, FIG. 3*c* is a front view, FIG. 3*d* is a top view, and FIG. 3*e* is a cross-sectional view taken along line 3*e*-3*e* in FIG. 3*d;*

DETAILED DESCRIPTION

Figure 1A:
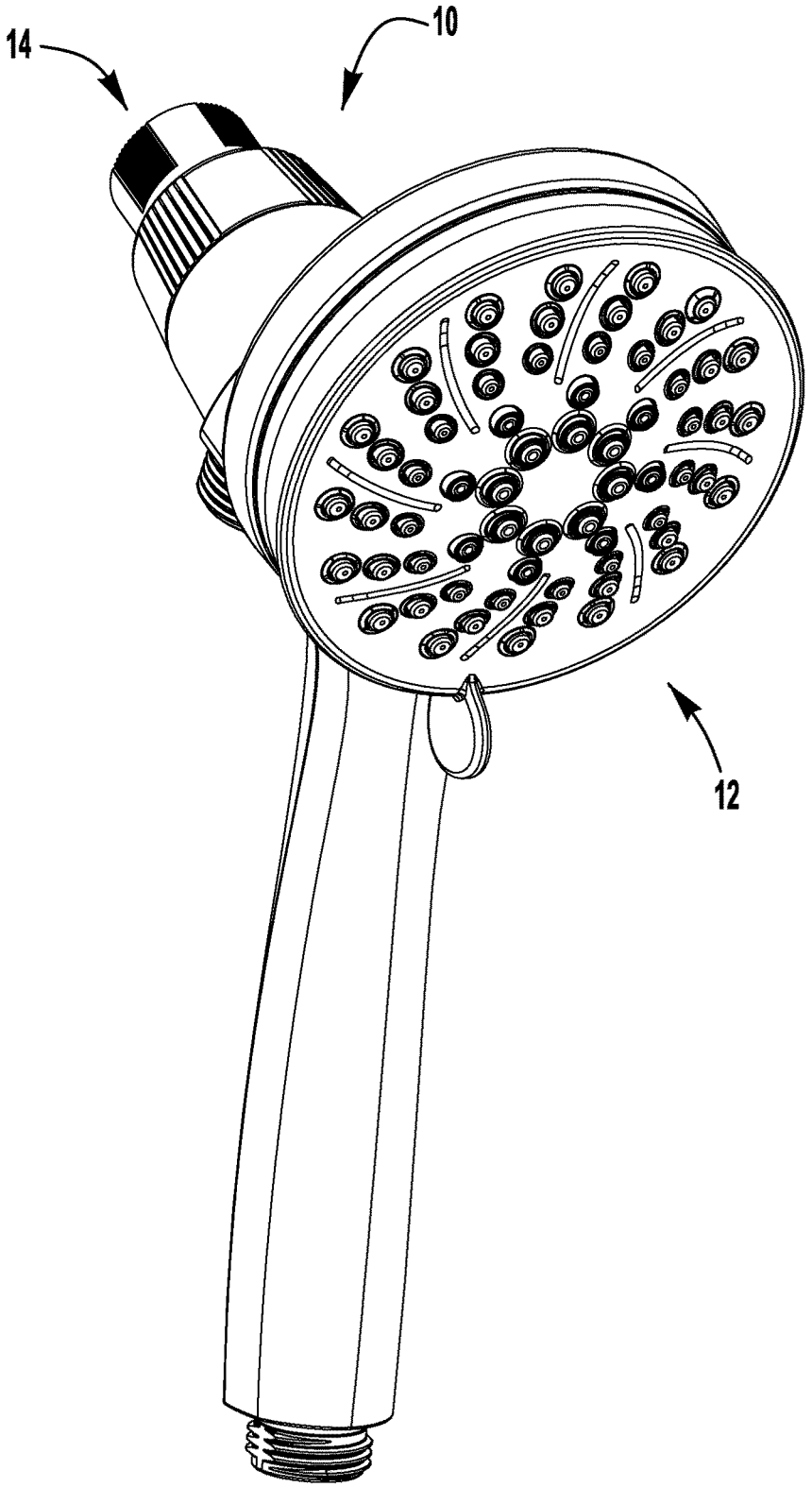
FIGS. 1*a*-1*e* are views of a handheld shower system, including a handheld and a cradle, in a docked position, according to an exemplary embodiment of the present invention
Figure 1C:
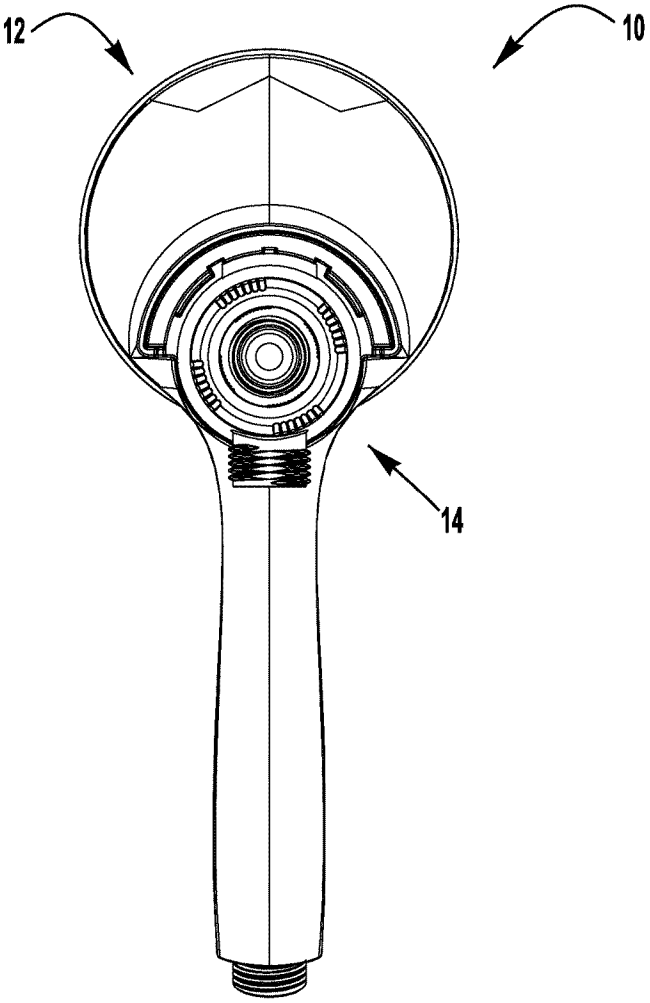
Figure 1B:
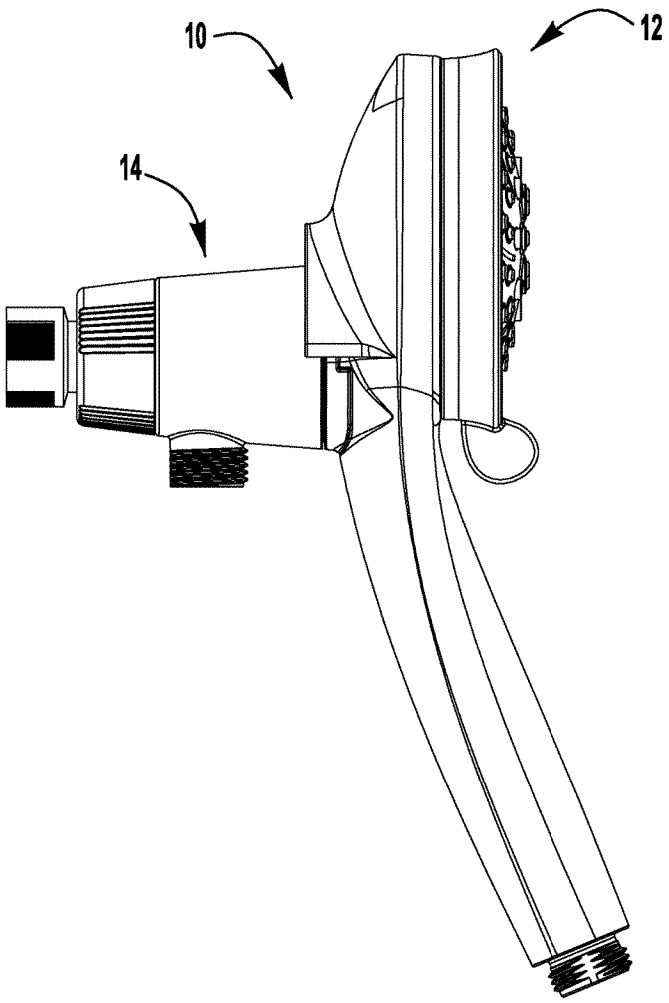
Figure 1D:
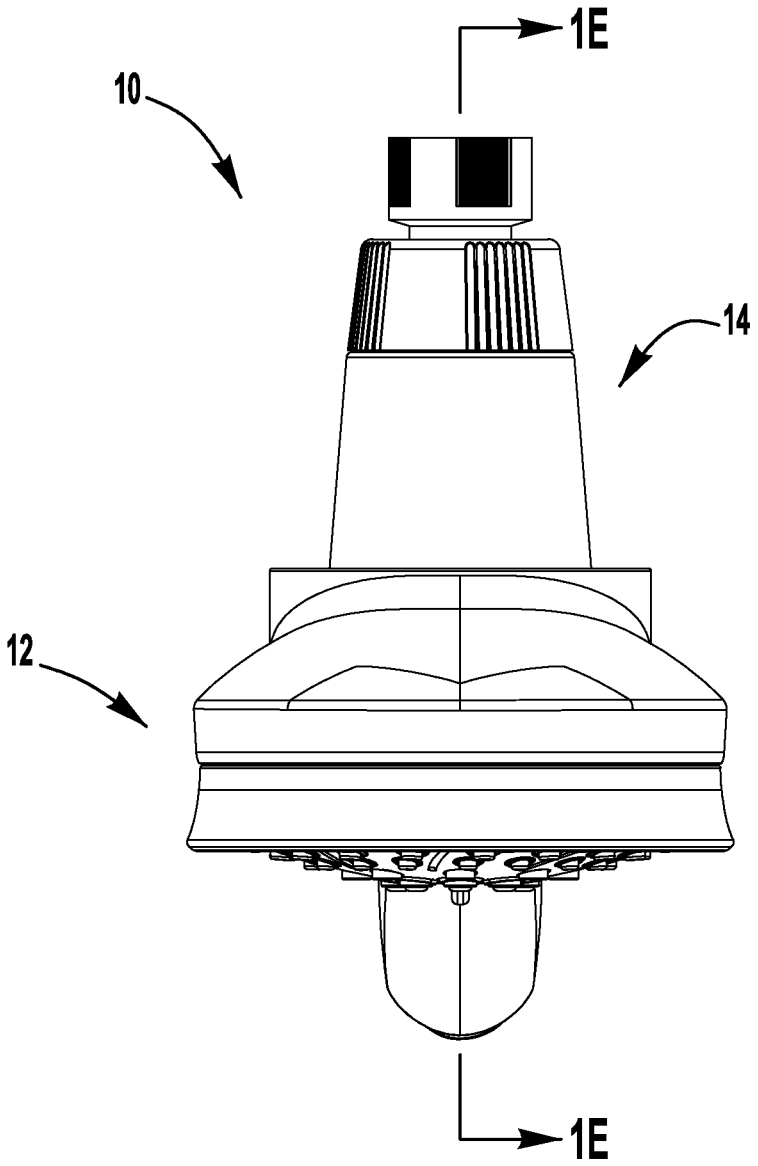
Figure 1E:
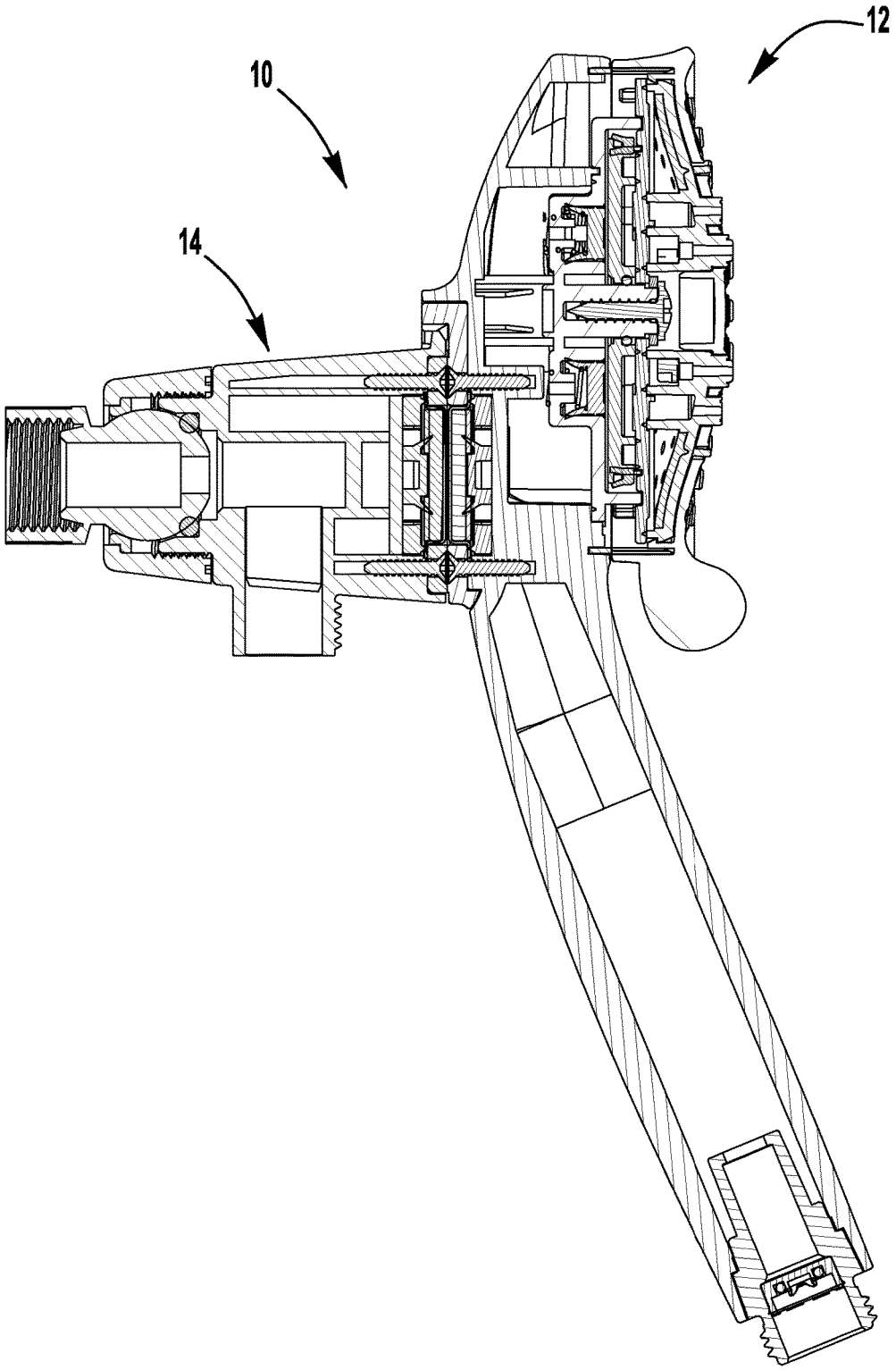
Figure 2A:
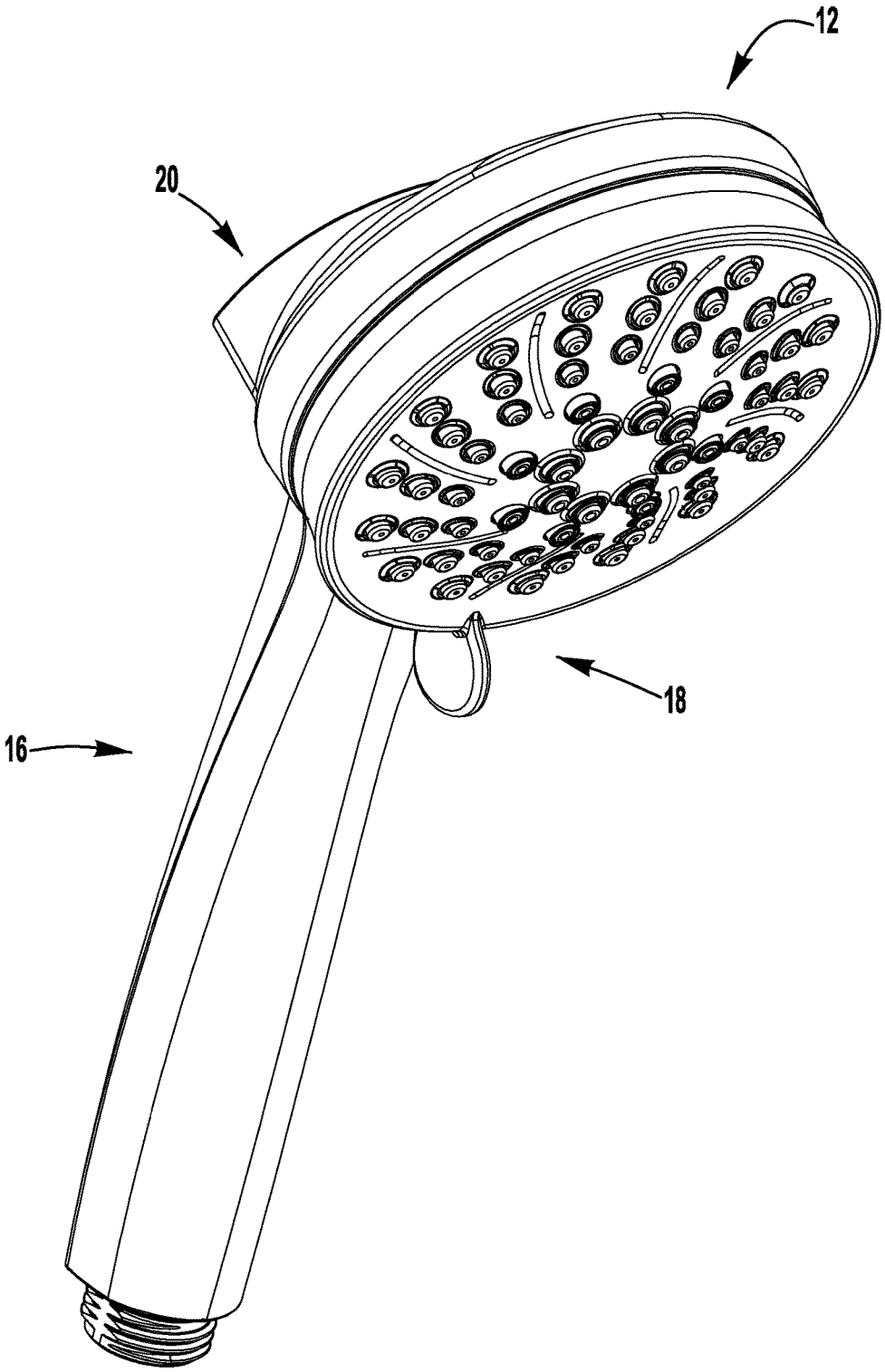
FIGS. 2*a*-2*g* are views of the handheld of FIGS. 1*a*-1*e
Figure 2B:
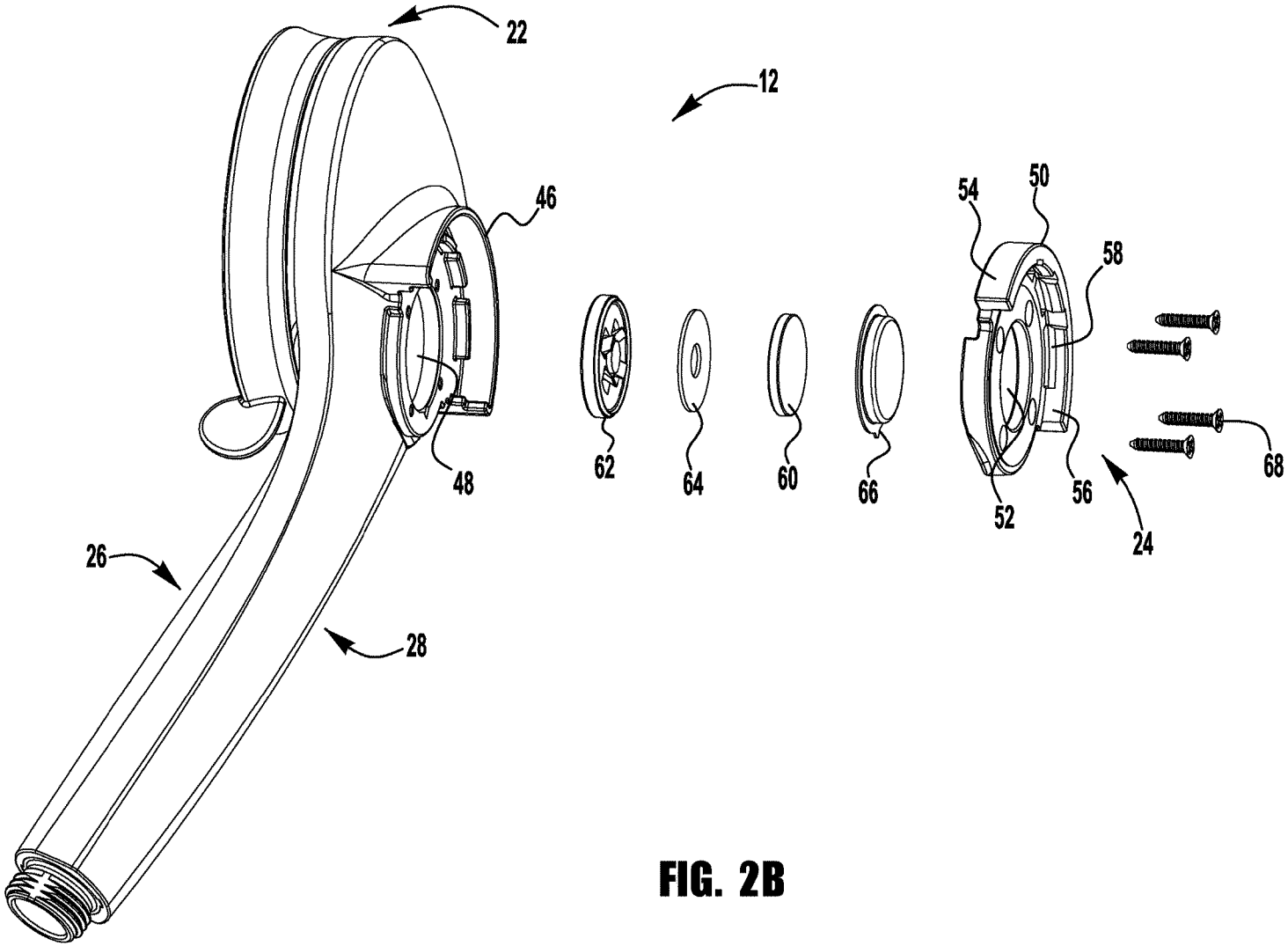
Figure 2E:
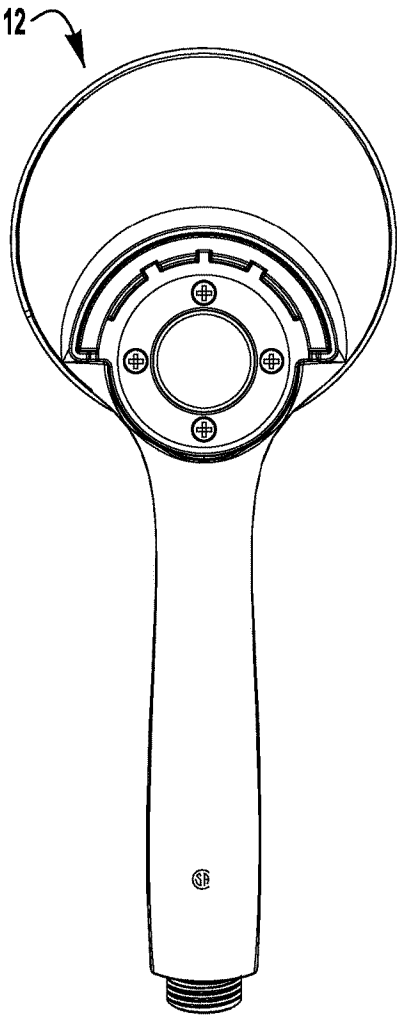
Figure 2D:
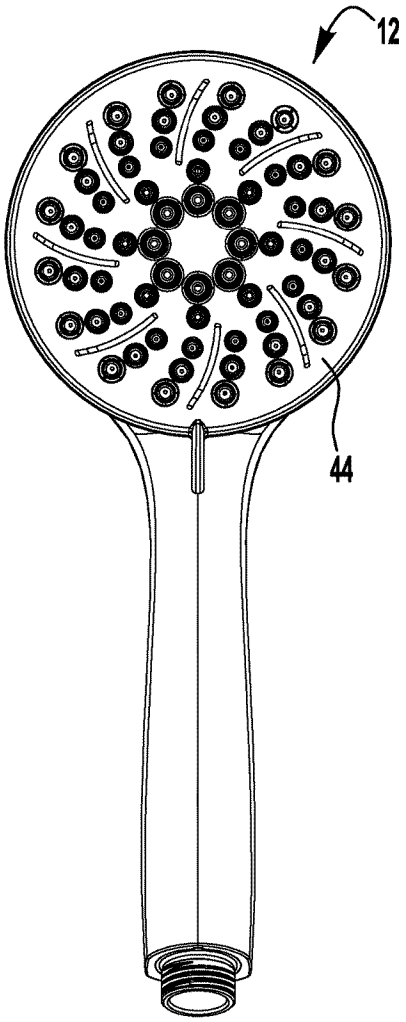
Figure 2C:
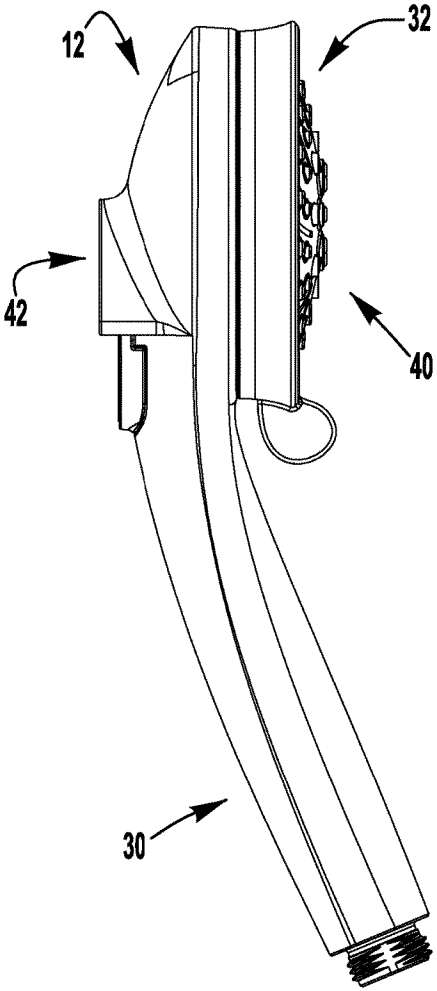
Figure 2F:
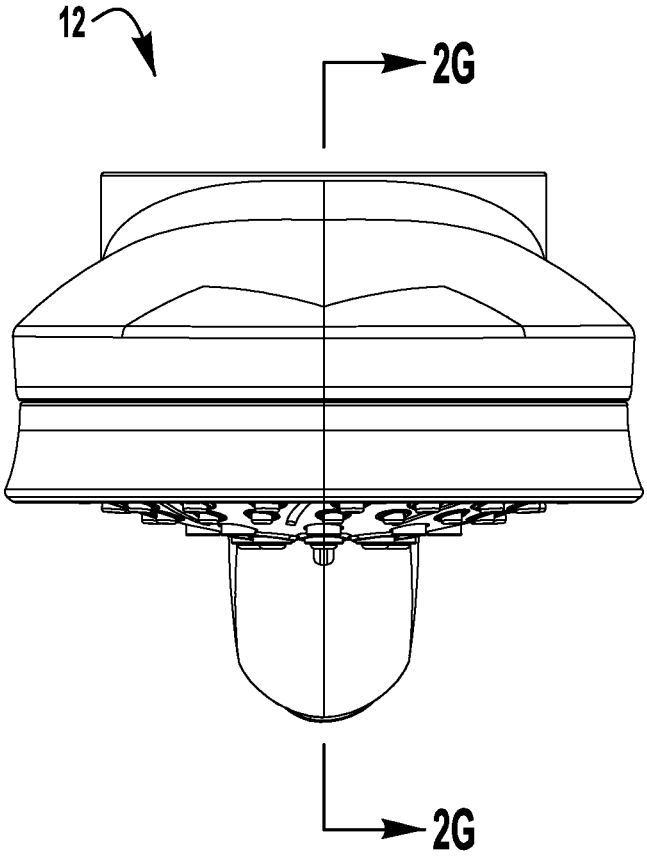
Figure 2G:
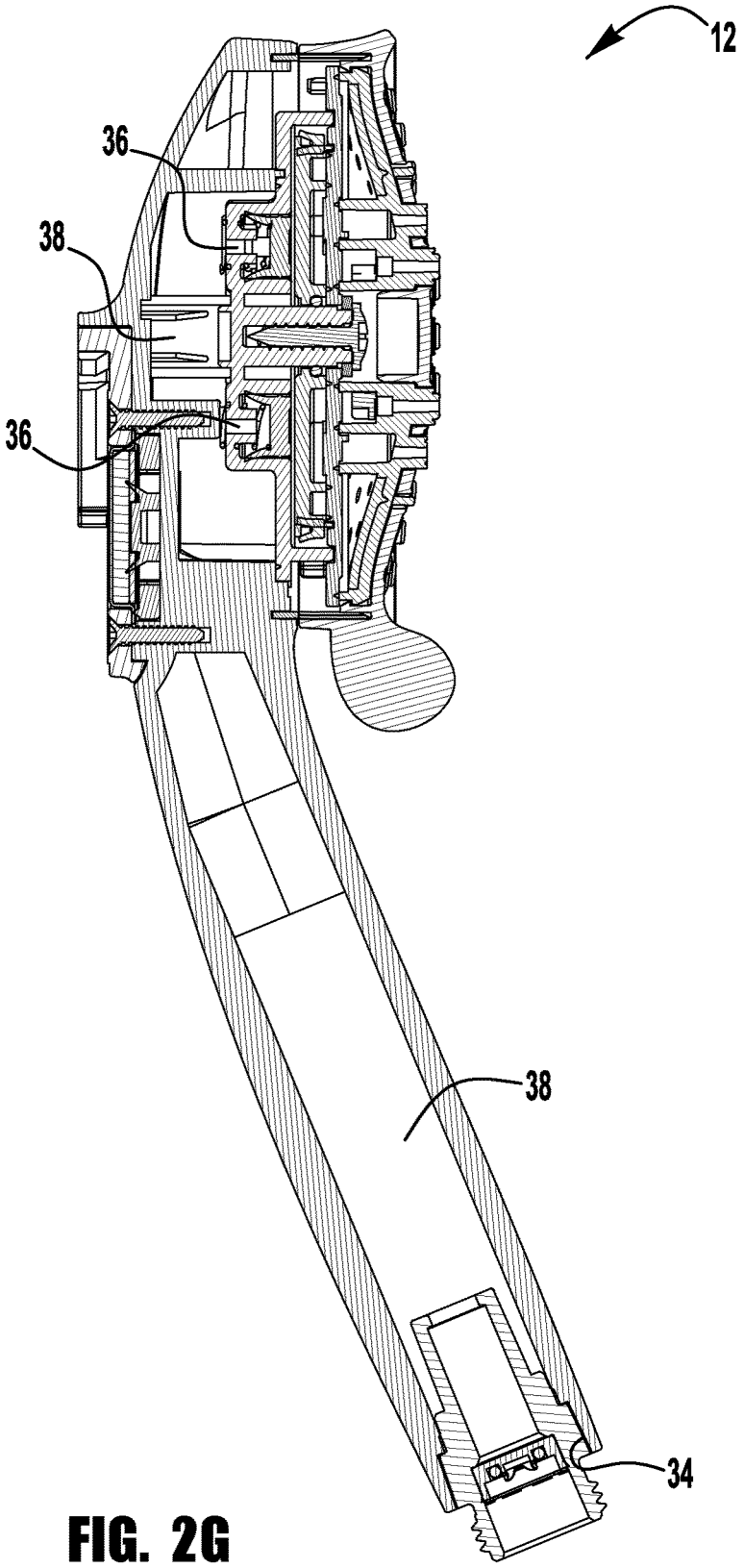

The present invention provides a handheld shower system with magnetic docking and a mechanical retention feature.

An exemplary embodiment of a handheld shower system 10 of the present invention is shown in detail in FIGS. 1*a*-5. In the illustrated embodiment, the handheld shower system 10 includes a handheld 12 and a cradle 14.

An exemplary embodiment of the handheld 12 is shown in detail in FIGS. 2*a*-2*g*. The handheld 12 includes a handheld housing 16. The handheld housing 16 has a front side 18 and a back side 20. In the illustrated embodiment, the handheld housing 16 includes a handheld body 22 and a handheld cover 24. The handheld body 22 has a front side 26 and a back side 28. In the illustrated embodiment, the handheld body 22 includes a handle 30 and a head 32. The handle 30 includes an inlet 34. The inlet 34 is operable to connect to a hose. The head 32 includes an outlet 36. The handheld body 22 includes a passageway 38 extending between the inlet 34 and the outlet 36. The head 32 has a front side 40 and a back side 42. The front side 40 of the head 32 is operable to attach to a spray face 44. The spray face 44 is operable to deliver fluid from the handheld 12. In the illustrated embodiment, the spray face 44 is operable to deliver fluid from the handheld 12 in a plurality of modes, such as spray and massage. In the illustrated embodiment, the back side 42 of the head 32 is operable to attach to the handheld cover 24. In the illustrated embodiment, the back side 42 of the head 32 includes a lip 46 and a handheld recess 48. In the illustrated embodiment, the handheld cover 24 includes a lip 50 and a handheld opening 52. The lip 50 on the handheld cover 24 has a top side 54 and a bottom side 56. In the illustrated embodiment, the bottom side 56 of the lip 50 includes an undercut 58. In the illustrated embodiment, the back side 20 of the handheld housing 16 includes the back side 28 of the handheld body 22 and the handheld cover 24.

In an exemplary embodiment, the handheld recess 48 is operable to receive a handheld magnet 60. The handheld magnet 60 is operable to produce a magnetic field that has a strength. In the illustrated embodiment, the handheld recess 48 is operable to receive a handheld magnet seal 62, a handheld metal disk 64, the handheld magnet 60, a handheld magnet cover 66, and the handheld cover 24. The handheld magnet seal 62 is operable to prevent water from coming into contact with the handheld magnet 60. The handheld metal disk 64 is operable to increase a strength of an attachment force acting on the handheld magnet 60. In an exemplary embodiment, the handheld metal disk 64 is made from an iron based metal, such as steel. The handheld magnet cover 66 is operable to compress the handheld magnet seal 62. In an exemplary embodiment, the handheld magnet cover 66 is made from a metal, such as brass. In the illustrated embodiment, the handheld magnet seal 62, the handheld metal disk 64, the handheld magnet 60, and the handheld magnet cover 66 are secured in the handheld recess 48 by the handheld cover 24. In the illustrated embodiment, the handheld cover 24 is secured to the handheld body 22 using screws 68 or other suitable fasteners.

An exemplary embodiment of the cradle 14 is shown in detail in FIG. 3*a*-3*e*. The cradle 14 includes a cradle housing 70. In the illustrated embodiment, the cradle housing 70 includes a cradle body 72 and a cradle cover 74. In the illustrated embodiment, the cradle body 72 is generally cylindrical shaped. The cradle body 72 includes an inlet 76, an outlet 78, and a passageway 80 extending between the inlet 76 and the outlet 78. The inlet 76 is operable to connect to a water supply (typically, from a tub diverter valve). The outlet 78 is operable to connect to the hose that is also connected to the inlet 34 in the handle 30 of the handheld 12. The cradle body 72 has a front end 82 and a back end 84. In the illustrated embodiment, the front end 82 of the cradle body 72 includes a tab 86 and a cradle recess 88. The tab 86 has a front side 90, a back side 92, and a top side 94. In the illustrated embodiment, the front side 90 of the tab 86 includes a chamfer 96. In the illustrated embodiment, the back side 92 of the tab 86 is generally flat. In the illustrated embodiment, the top side 94 of the tab 86 is generally curved. In the illustrated embodiment, the tab 86 extends radially outwardly from the cradle body 72. In the illustrated embodiment, the cradle cover 74 includes a cradle opening 98.

In an exemplary embodiment, the cradle recess 88 is operable to receive a cradle magnet 100. The cradle magnet 100 is operable to produce a magnetic field that has a strength. In the illustrated embodiment, the cradle recess 88 is operable to receive a cradle support 102, a cradle magnet seal 104, a cradle metal disk 106, the cradle magnet 100, a cradle magnet cover 108, and the cradle cover 74. The cradle support 102 is operable to provide a sealing surface for the cradle magnet seal 104. The cradle magnet seal 104 is operable to prevent water from coming into contact with the cradle magnet 100. The cradle metal disk 106 is operable to increase a strength of an attachment force acting on the cradle magnet 100. In an exemplary embodiment, the cradle metal disk 106 is made from an iron based metal, such as steel. The cradle magnet cover 108 is operable to compress the cradle magnet seal 104. In an exemplary embodiment, the cradle magnet cover 108 is made from a metal, such as brass. In the illustrated embodiment, the cradle support 102, the cradle magnet seal 104, the cradle metal disk 106, the cradle magnet 100, and the cradle magnet cover 108 are secured in the cradle recess 88 by the cradle cover 74. In the illustrated embodiment, the cradle cover 74 is secured to the cradle body 72 using screws 110 or other suitable fasteners.

The use of the handheld shower system 10 will now be described. During non-use or hands-free use, the handheld 12 is docked on the cradle 14, as shown in FIGS. 1*a*-1*e*. In an exemplary embodiment, the handheld 12 is docked on the cradle 14 by moving the handheld 12 toward the cradle 14 so that the handheld magnet 60 is generally aligned with the cradle magnet 100. As the handheld 12 moves toward the cradle 14, the magnetic field produced by the handheld magnet 60 interacts with the magnetic field produced by the cradle magnet 100 and produces an attachment force that has a strength. A distance at which the attachment force produced by the handheld magnet 60 and the cradle magnet 100 becomes effective depends upon the strength of the magnetic field produced by the handheld magnet 60 and the strength of the magnetic field produced by the cradle magnet 100. In an exemplary embodiment, the attachment force produced by the handheld magnet 60 and the cradle magnet 100 becomes effective when a distance between the handheld magnet 60 and the cradle magnet 100 is approximately one and one-quarter inches (1¼ in.). In an exemplary embodiment, a surface-to-surface attachment force produced by the handheld magnet 60 and the cradle magnet 100 is approximately ten pounds (10 lbs.). As the handheld 12 comes into contact with the cradle 14, the bottom side 56 of the lip 50 on the handheld cover 24 contacts the front side 90 of the tab 86 on the cradle body 72. The chamfer 96 on the front side 90 of the tab 86 causes the bottom side 56 of the lip 50 to slide up and over the tab 86. The tab 86 moves into the undercut 58 in the lip 50.

Figure 4:
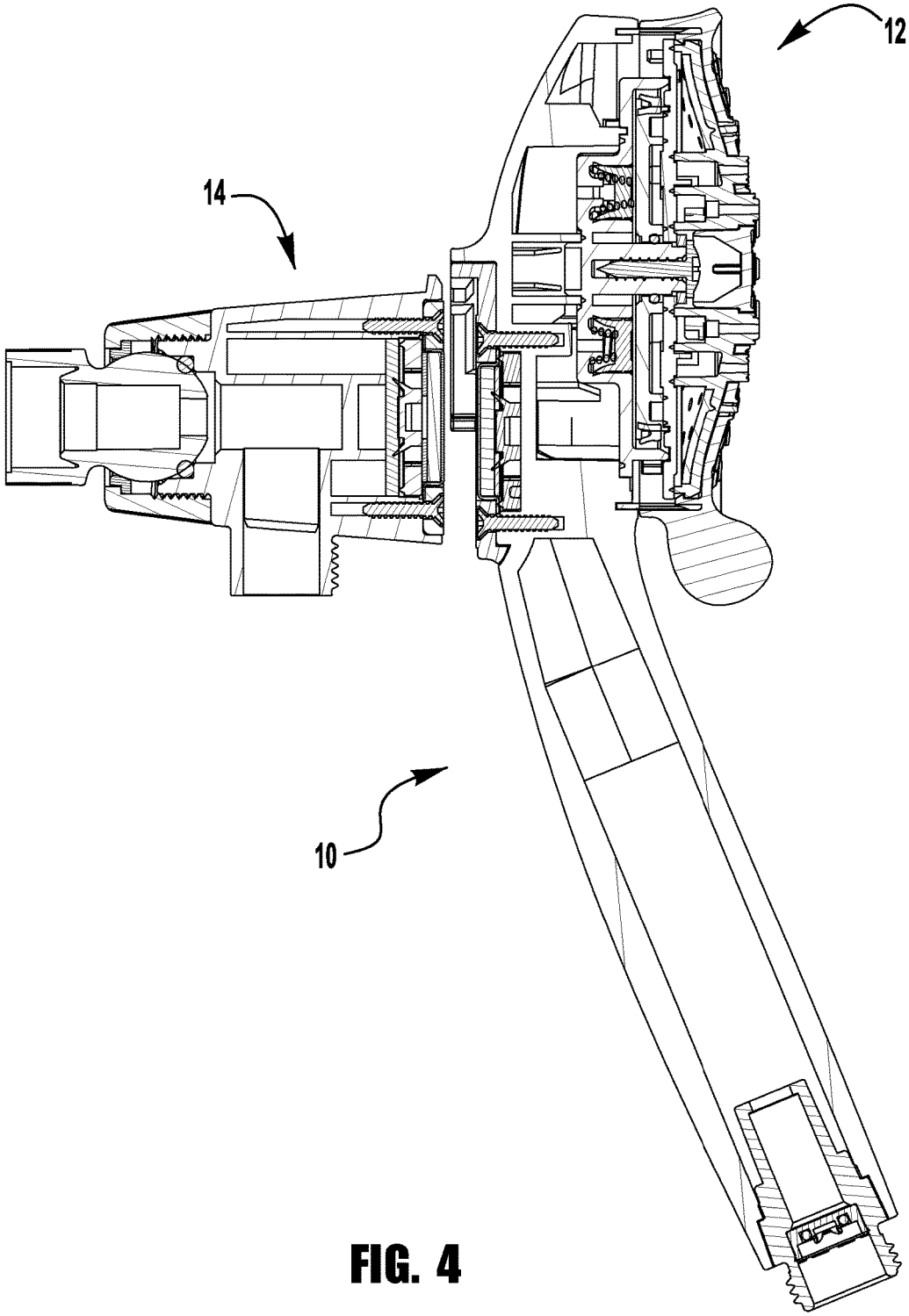
FIG. 4 is a cross-sectional view of the handheld shower system of FIGS. 1*a*-1*e*, in an undocked position, taken along a line similar to line 1*e*-1*e* in FIG. 1*d*.

When the handheld 12 is desired to be manually used, the handheld 12 is undocked from the cradle 14, as shown in FIG. 4. In an exemplary embodiment, the handheld 12 is undocked from the cradle 14 by moving the handheld 12 away from the cradle 14 until the magnetic field of the handheld magnet 60 no longer interacts with the magnetic field of the cradle magnet 100 and lifting the handheld 12 so that the tab 86 on the cradle body 72 moves out of the undercut 58 in the lip 50 on the handheld cover 24.

Figure 5:
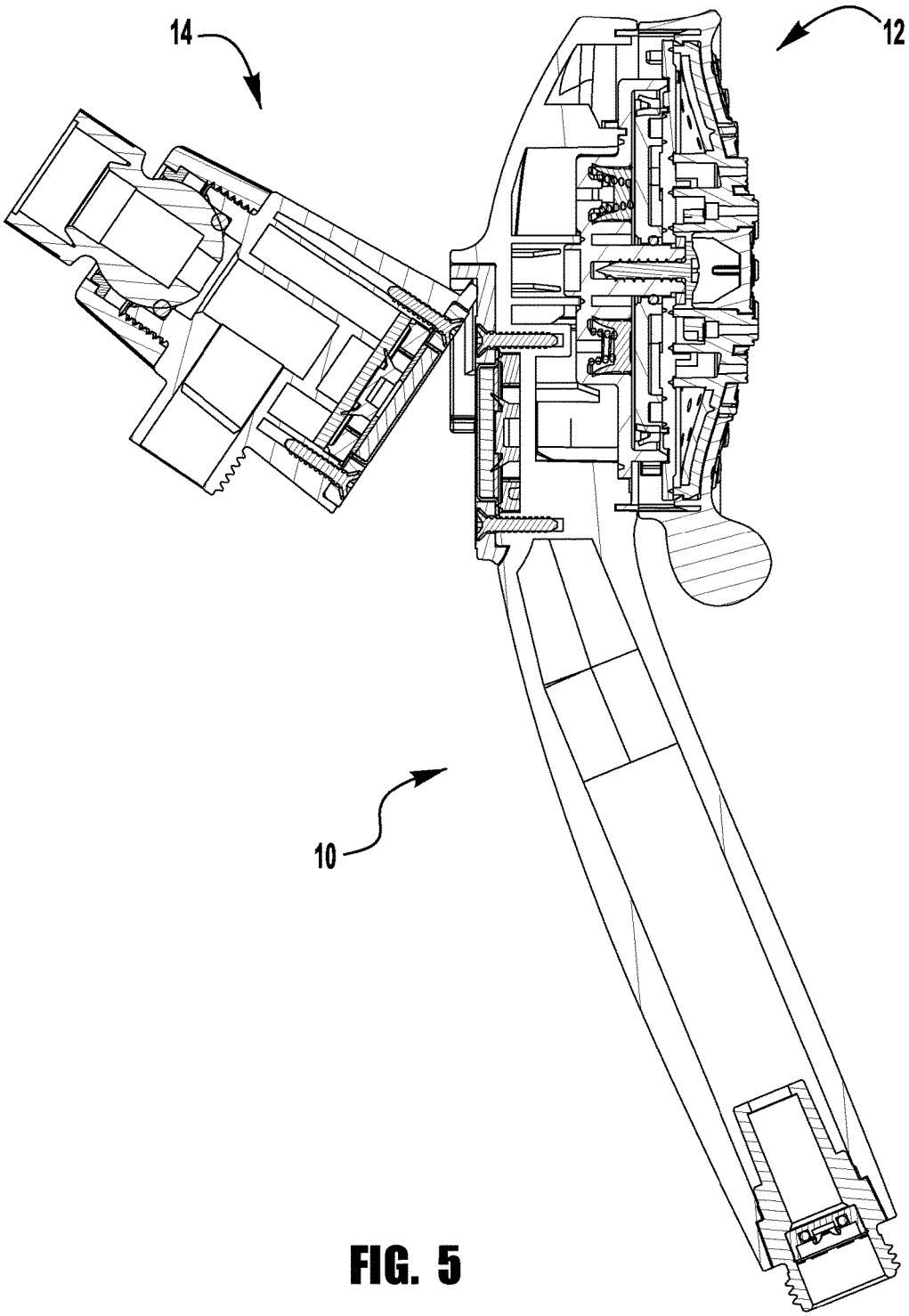
FIG. 5 is a cross-sectional view of the handheld shower system of FIGS. 1*a*-1*e*, in a retained position, taken along a line similar to line 1*e*-1*e* in FIG. 1*d*.

As a downward force is applied to the handheld 12 while the handheld 12 is docked on the cradle 14, the tab 86 on the cradle 14 contacts the lip 50 on the handheld 12 and, more particularly, the undercut 58 in the lip 50 on the handheld 12, and the handheld 12 is retained on the cradle 14, as shown in FIG. 5. As an upward force is applied to the handheld 12 while the handheld 12 is docked on the cradle 14, the tab 86 on the cradle 14 does not contact the lip 50 on the handheld 12 and, more particularly, the undercut 58 in the lip 50 on the handheld 12, and the handheld 12 becomes undocked from the cradle 14. The amount of upward force that needs to be applied to move the tab 86 out of the lip 50 and, more particularly, the undercut 58 in the lip 50, will depend upon the orientation of the cradle 14.

While the handheld shower system 10 has been shown and described in the illustrated embodiment as including components having certain features, one of ordinary skill in the art will appreciate that the handheld shower system 10 could have these features on other components.

As an example, in the illustrated embodiment, the handheld 12 includes the lip 50, and the cradle 14 includes the tab 86. However, one of ordinary skill in the art will appreciate that the handheld 12 could include the tab, and the cradle 14 could include the lip.

As another example, in the illustrated embodiment, the handheld cover 24 includes the lip 50, and the cradle body 72 includes the tab 86. However, one of ordinary skill in the art will appreciate that other portions of the handheld 12 could include the lip, such as the head 32 or the handle 30 of the handheld body 22, and other portions of the cradle 14 could include the tab, such as the cradle cover 74.

As another example, in the illustrated embodiment, the handheld body 22 includes the lip 46, and the handheld cover 24 includes the lip 50. In the illustrated embodiment, the lip 46 on the handheld body 22 is for decorative purposes, and the lip 50 on the handheld cover 24 interfaces with the tab 86 on the cradle body 72. However, one of ordinary skill in the art will appreciate that the lip 46 on the handheld body 22 could be used to interface with the tab 86 on the cradle body 72.

While the handheld shower system 10 has been shown and described in the illustrated embodiment as including certain components, one of ordinary skill in the art will appreciate that the handheld shower system 10 does not need to include each of these components.

As an example, in the illustrated embodiment, the handheld housing 16 includes a handheld body 22 and a handheld cover 24, and the cradle housing 70 includes a cradle body 72 and a cradle cover 74. However, one of ordinary skill in the art will appreciate that the handheld housing 16 could be integrally formed or could be formed from more than two components, and the cradle housing 70 could be integrally formed or could be formed from more than two components.

As another example, in the illustrated embodiment, the handheld 12 includes the handheld magnet 60, and the cradle 14 includes the cradle magnet 100. However, one of ordinary skill in the art will appreciate that one of the handheld 12 and the cradle 14 could include the magnet, and the other of the handheld 12 and the cradle 14 could include a magnetically attractable material.

As another example, in the illustrated embodiment, the handheld 12 includes the handheld metal disk 64, and the cradle 14 includes the cradle metal disk 106. However, one of ordinary skill in the art will appreciate that either or both of the handheld 12 and the cradle 14 could not include the metal disk. As stated above, the handheld metal disk 64 increases the strength of the attachment force acting on the handheld magnet 60, and the cradle metal disk 106 increases the strength of the attachment force acting on the cradle magnet 100. However, one of ordinary skill in the art will appreciate that a handheld magnet that produces a stronger magnetic field could be used instead of the handheld magnet 60 and the handheld metal disk 64, and/or a cradle magnet that produces a stronger magnetic field could be used instead of the cradle magnet 100 and the cradle metal disk 106.

While the handheld shower system 10 has been shown and described in the illustrated embodiment as including components having certain shapes, sizes, and configurations and made of certain materials, one of ordinary skill in the art will appreciate that the components of the handheld shower system 10 do not need to have theses shapes, sizes, and configurations and be made of these materials.

As an example, in the illustrated embodiment, the lip 50 on the handheld cover 24 is generally arc-shaped. However, one of ordinary skill in the art will appreciate that the lip 50 could have other shapes. Moreover, the lip 50 could be smaller or larger and could even be enclosed.

As another example, in the illustrated embodiment, the tab 86 on the cradle 14 has the chamfered front side 90, the generally flat back side 92, and the generally curved top side 94. However, one of ordinary skill in the art will appreciate that the tab 86 could have other shapes. Moreover, the tab 86 could be smaller or larger.

As another example, in the illustrated embodiment, the tab 86 on the cradle body 72 extends radially outwardly from the cradle body 72. However, one of ordinary skill in the art will appreciate that the tab 86 could extend in other directions so long as the tab 86 is operable to interface with the lip 50 and retain the handheld 12 on the cradle 14.

As another example, in the illustrated embodiment, the handheld magnet cover 66 and the cradle magnet cover 108 are made of metal. However, one of ordinary skill in the art will appreciate that the handheld magnet cover 66 and the cradle magnet cover 108 could be made of other materials, including plastic. One of ordinary skill in the art will also appreciate that if the handheld magnet cover 66 and the cradle magnet cover 108 are made of plastic, the handheld magnet cover 66 and the cradle magnet cover 108 will likely be thicker and the strength of the magnetic field produced by the handheld magnet 60 and/or the strength of the magnetic field produced by the cradle magnet 100 will need to be increased.

While the handheld shower system 10 has been shown and described in the illustrated embodiment with the components of the handheld shower system 10 attached and used in a particular manner, one of ordinary skill in the art will appreciate that the components of the handheld shower system 10 do not need to be attached and used in this manner.

As an example, as described above, the handheld 12 is docked on the cradle 14 by moving the handheld 12 toward the cradle 14 until the bottom side 56 of the lip 50 on the handheld cover 24 contacts the front side 90 of the tab 86 on the cradle body 72 and slides up and over the tab 86 and into the undercut 58 in the lip 50. However, one of ordinary skill in the art will appreciate that the handheld 12 could be docked on the cradle 14 by moving the handheld 12 toward the cradle 14 with the bottom side 56 of the lip 50 on the handheld cover 24 in a position higher than the front side 90 of the tab 86 on the cradle body 72 and lowering the handheld 12 until the tab 86 slides into the undercut 58 in the lip 50.

As another example, as described above, the handheld 12 is undocked from the cradle 14 by moving the handheld 12 away from the cradle 14 and lifting the handheld 12 so that the tab 86 on the cradle body 72 moves out of the undercut 58 in the lip 50 on the handheld cover 24. However, one of ordinary skill in the art will appreciate that the handheld 12 could be undocked from the cradle 14 by lifting the handheld 12 so that the tab 86 moves out of the undercut 58 in the lip 50 and moving the handheld 12 away from the cradle 14.

Figure 3C:
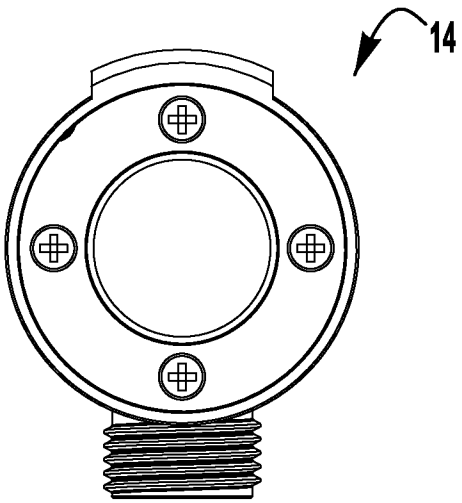
FIGS. 3*a*-3*e* are views of the cradle of FIGS. 1*a*-1*e
Figure 3A:
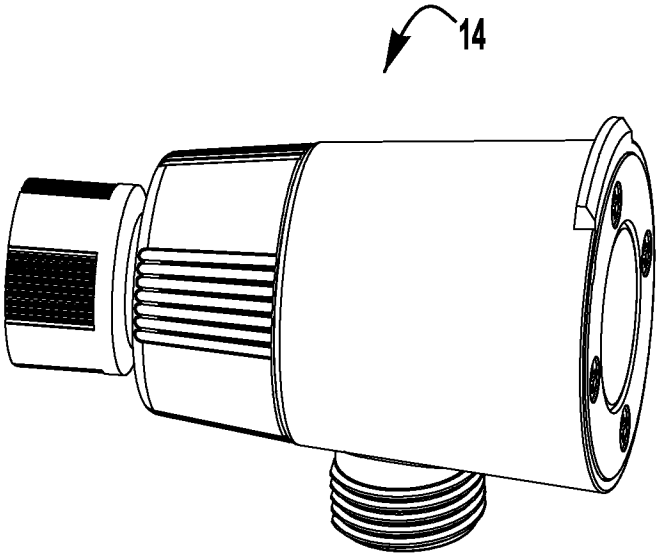
Figure 3B:
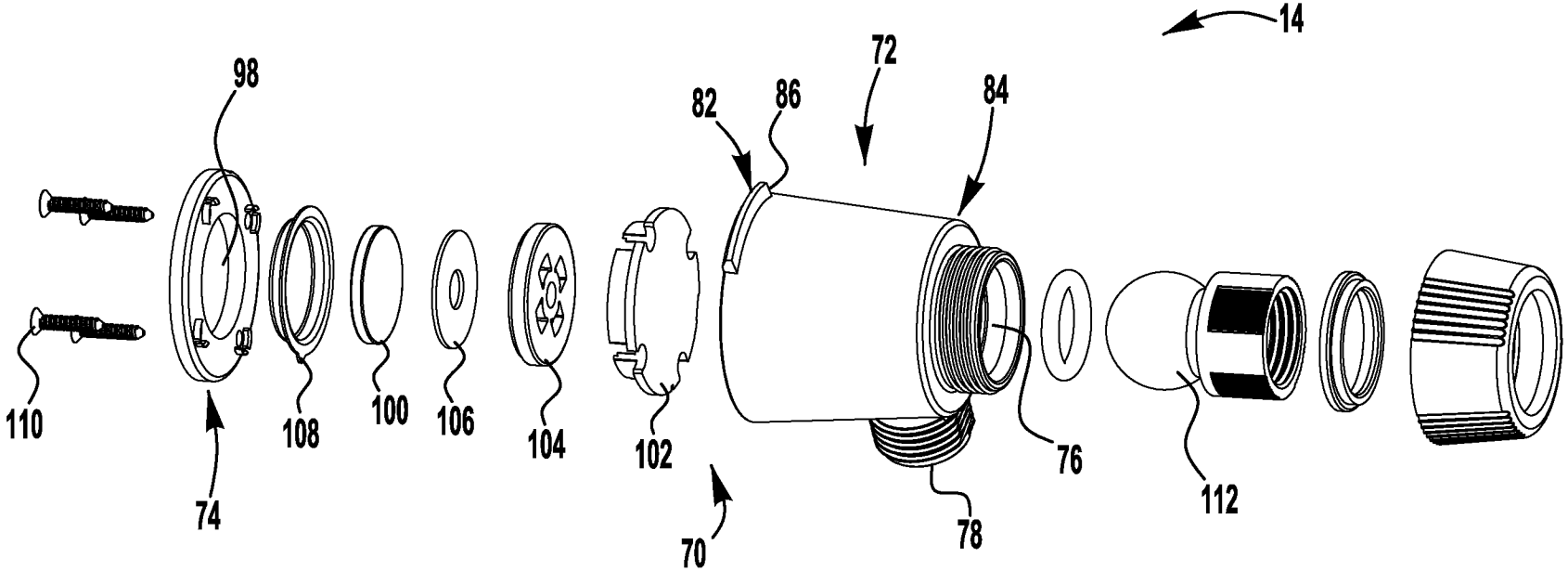
Figure 3E:
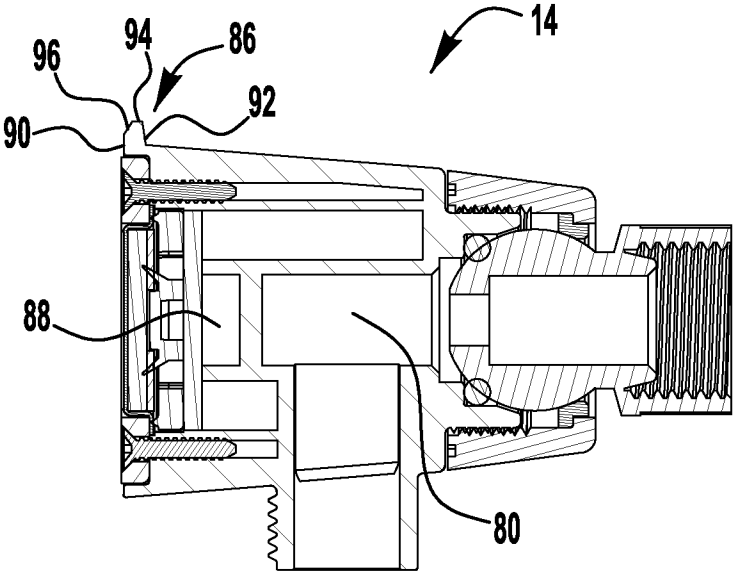
Figure 3D:
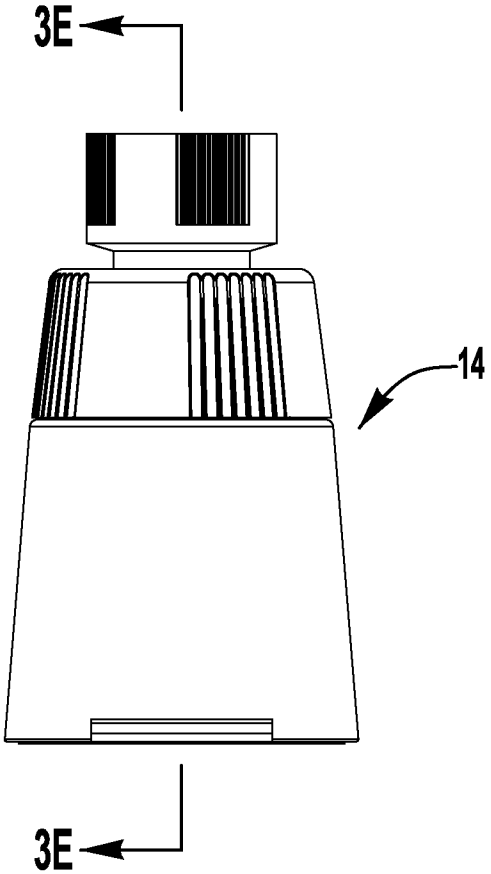

As shown and described in the illustrated embodiment in FIG. 3*b*, the cradle 14 includes a ball swivel joint 112. The ball swivel joint 112 can be used to connect the cradle 14 to a standard shower arm extending from a wall. However, one of ordinary skill in the art will appreciate that the cradle 14 could be attached to any surface or any component of a bathing or showering system. For example, the cradle 14 could be attached directly to the wall, to a slide bar, or to a fixed showerhead.

In describing the components of the handheld shower system 10 and the docking and undocking of the handheld 12 on and from the cradle 14, terms describing the orientation of the components of the handheld shower system 10 are used. For example, the handheld housing 16 is described as having a front side 18 and a back side 20, the handheld body 22 is described as having a front side 26 and a back side 28, and the head 32 is described as having a front side 40 and a back side 42. Similarly, the lip 50 on the handheld cover 24 is described as having a top side 54 and a bottom side 56. Additionally, the cradle body 72 is described as having a front end 82 and a back end 84, and the tab 86 of the cradle body 72 is described as having a front side 90, a back side 92, and a top side 94. Likewise, reference is made to the bottom side 56 of the lip 50 sliding up and over the tab 86, lifting the handheld 12, and applying an upward force to the handheld 12. These terms describe the components of the handheld shower system 10 as oriented in the drawings. However, one of ordinary skill in the art will appreciate that the handheld shower system 10 could be oriented in any direction and that these terms are relative terms and are merely used for ease of reference in describing the components of the handheld shower system 10 and the docking and undocking of the handheld 12 on and from the cradle 14.

One of ordinary skill in the art will now appreciate that the present invention provides a handheld shower system with magnetic docking and a mechanical retention feature. Although the present invention has been shown and described with reference to a particular embodiment, equivalent alterations and modifications will occur to those skilled in the art upon reading and understanding this specification. The present invention includes all such equivalent alterations and modifications.

What is claimed is:

1. A handheld shower system, comprising:

a handheld, the handheld including a handheld housing, the handheld housing including a handle and a head, the handle including an inlet, the head including an outlet, the handheld housing including a passageway extending between the inlet and the outlet, the head having a front side and a back side, the front side of the head being operable to attach to a spray face; and a cradle, the cradle including a cradle housing, the cradle housing including an inlet, an outlet, and a passageway extending between the inlet and the outlet, the cradle housing having a front end and a back end;

wherein the outlet of the cradle housing is operable to be fluidly connected to the inlet of the handheld housing;

wherein one of the back side of the handheld housing and the front end of the cradle housing includes a lip, and the other of the back side of the handheld housing and the front end of the cradle housing includes a tab;

wherein the cradle housing does not include any spray nozzles;

wherein one of the handheld and the cradle includes a magnet, and the other of the handheld and the cradle includes a magnet or a magnetically attractable material;

wherein the handheld is docked on the cradle by attraction of the magnet of one of the handheld and the cradle to the magnet or the magnetically attractable material of the other of the handheld and the cradle;

wherein the attraction of the magnet of one of the handheld and the cradle to the magnet or the magnetically attractable material of the other of the handheld and the cradle is sufficient to retain the handheld on the cradle;

wherein, as a downward force is applied to the handheld while the handheld is docked on the cradle, the tab on one of the front end of the cradle housing and the back side of the handheld housing contacts the lip on the other of the front end of the cradle housing and the back side of the handheld housing and the handheld is retained on the cradle; and wherein, as an upward force is applied to the handheld while the handheld is docked on the cradle, the tab on one of the front end of the cradle housing and the back side of the handheld housing does not contact the lip on the other of the front end of the cradle housing and the back side of the handheld housing and the handheld becomes undocked from the cradle.

2. The handheld shower system of claim 1, wherein:

the back side of the handheld housing includes the lip; and the front end of the cradle housing includes the tab.

3. The handheld shower system of claim 1, wherein:

the lip has a top side and a bottom side; and the tab has a front side, a back side, and a top side.

4. The handheld shower system of claim 3, wherein:

the bottom side of the lip includes an undercut.

5. The handheld shower system of claim 3, wherein:

the front side of the tab includes a chamfer.

6. The handheld shower system of claim 1, wherein:

the handheld housing includes a handheld body and a handheld cover; and the handheld cover includes the lip.

7. The handheld shower system of claim 1, wherein:

the handheld housing includes a handheld body and a handheld cover; and the handheld body includes the lip.

8. A handheld shower system, comprising:

a handheld, the handheld including a handheld housing, the handheld housing including a handle and a head, the handle including an inlet, the head including an outlet, the handheld housing including a passageway extending between the inlet and the outlet, the head having a front side and a back side, the front side of the head being operable to attach to a spray face; and a cradle, the cradle including a cradle housing, the cradle housing including an inlet, an outlet, and a passageway extending between the inlet and the outlet, the cradle housing having a front end and a back end;

wherein the outlet of the cradle housing is operable to be fluidly connected to the inlet of the handheld housing;

wherein one of the back side of the handheld housing and the front end of the cradle housing includes a lip, and the other of the back side of the handheld housing and the front end of the cradle housing includes a tab;

wherein one of the handheld and the cradle includes a magnet, and the other of the handheld and the cradle includes a magnet or a magnetically attractable material;

wherein the handheld is docked on the cradle by attraction of the magnet of one of the handheld and the cradle to the magnet or the magnetically attractable material of the other of the handheld and the cradle;

wherein the attraction of the magnet of one of the handheld and the cradle to the magnet or the magnetically attractable material of the other of the handheld and the cradle is sufficient to retain the handheld on the cradle;

wherein no portion of the cradle housing surrounds any portion of the head of the handheld housing that is at or above the lip or the tab on the back side of the handheld housing when the handheld is docked on the cradle;

wherein, as a downward force is applied to the handheld while the handheld is docked on the cradle, the tab on one of the front end of the cradle housing and the back side of the handheld housing contacts the lip on the other of the front end of the cradle housing and the back side of the handheld housing and the handheld is retained on the cradle; and wherein, as an upward force is applied to the handheld while the handheld is docked on the cradle, the tab on one of the front end of the cradle housing and the back side of the handheld housing does not contact the lip on the other of the front end of the cradle housing and the back side of the handheld housing and the handheld becomes undocked from the cradle.

9. The handheld shower system of claim 8, wherein:

the lip has a top side and a bottom side; and the tab has a front side, a back side, and a top side.

10. The handheld shower system of claim 9, wherein:

the bottom side of the lip includes an undercut.

11. The handheld shower system of claim 9, wherein:

the front side of the tab includes a chamfer.

12. The handheld shower system of claim 8, wherein:

the back side of the handheld housing includes the lip; and the front end of the cradle housing includes the tab.

13. The handheld shower system of claim 8, wherein:

the handheld housing includes a handheld body and a handheld cover; and the handheld cover includes the lip.

14. The handheld shower system of claim 8, wherein:

the handheld housing includes a handheld body and a handheld cover; and the handheld body includes the lip.

15. A handheld shower system, comprising:

a handheld, the handheld including a handheld housing, the handheld housing including a handle and a head, the handle including an inlet, the head including an outlet, the handheld housing including a passageway extending between the inlet and the outlet, the head having a front side and a back side, the front side of the head being operable to attach to a spray face, the back side of the handheld housing including a lip and a first surface located below the lip; and a cradle, the cradle including a cradle housing, the cradle housing including an inlet, an outlet, and a passageway extending between the inlet and the outlet, the cradle housing having a front end and a back end, the front end of the cradle housing including a top portion, the top portion of the front end of the cradle housing including a tab, the front end of the cradle housing including a second surface located below the tab;

wherein the outlet of the cradle housing is operable to be fluidly connected to the inlet of the handheld housing;

wherein one of the handheld and the cradle includes a magnet, and the other of the handheld and the cradle includes a magnet or a magnetically attractable material;

wherein the handheld is docked on the cradle by attraction of the magnet of one of the handheld and the cradle to the magnet or the magnetically attractable material of the other of the handheld and the cradle;

wherein the attraction of the magnet of one of the handheld and the cradle to the magnet or the magnetically attractable material of the other of the handheld and the cradle is sufficient to retain the handheld on the cradle;

wherein no portion of the cradle housing surrounds any portion of the head of the handheld housing that is at or above the lip on the back side of the handheld housing when the handheld is docked on the cradle;

wherein the first surface of the back side of the handheld housing abuts the second surface of the front end of the cradle housing when the handheld is docked on the cradle;

wherein, to undock the handheld from the cradle, an undocking force is applied to the handheld resulting in an undocking movement of the handheld, the undocking movement including a rotational component and an upward translational component;

wherein the tab on the top portion of the front end of the cradle housing is received in the lip on the back side of the handheld housing when the handheld is docked on the cradle such that the handheld must be rotated and moved upwardly to be undocked from the cradle;

wherein, as a downward force is applied to the handheld while the handheld is docked on the cradle, the tab on the top portion of the front end of the cradle housing contacts the lip on the back side of the handheld housing and the handheld is retained on the cradle; and wherein, as an upward force is applied to the handheld while the handheld is docked on the cradle, the tab on the top portion of the front end of the cradle housing does not contact the lip on the back side of the handheld housing and the handheld becomes undocked from the cradle.

16. The handheld shower system of claim 15, wherein:

the lip has a top side and a bottom side; and the tab has a front side, a back side, and a top side.

17. The handheld shower system of claim 16, wherein:

the bottom side of the lip includes an undercut.

18. The handheld shower system of claim 16, wherein:

the front side of the tab includes a chamfer.

19. The handheld shower system of claim 15, wherein:

the handheld housing includes a handheld body and a handheld cover; and the handheld cover includes the lip.

20. The handheld shower system of claim 15, wherein:

the handheld housing includes a handheld body and a handheld cover; and the handheld body includes the lip.

* * * * *